US007455041B2

(12) United States Patent
Meyer et al.

(10) Patent No.: US 7,455,041 B2
(45) Date of Patent: Nov. 25, 2008

(54) RECIPROCATING-PISTON INTERNAL COMBUSTION ENGINE

(75) Inventors: Markus Meyer, Mildenau (DE); Frank Van Der Seylberg, Chemnitz (DE)

(73) Assignee: IAV GmbH Ingenieurgesellschaft Auto und Verkehr, Berlin (DE)

( * ) Notice: Subject to any disclaimer, the term of this patent is extended or adjusted under 35 U.S.C. 154(b) by 60 days.

(21) Appl. No.: 11/656,752

(22) Filed: Jan. 23, 2007

(65) Prior Publication Data

US 2007/0169739 A1 Jul. 26, 2007

(30) Foreign Application Priority Data

Jan. 24, 2006 (DE) ..... 10 2006 003 737

(51) Int. Cl.
*F02B 75/32* (2006.01)

(52) U.S. Cl. ..... 123/197.4; 123/78 E

(58) Field of Classification Search ..... 123/48 B, 123/78 E, 197.3–197.4, 78 BA
See application file for complete search history.

(56) References Cited

U.S. PATENT DOCUMENTS

| | | | | | |
|---|---|---|---|---|---|
| 939,669 | A * | 11/1909 | Cole | 123/197.4 |
| 4,449,494 | A * | 5/1984 | Beaudoin | 123/59.6 |
| 4,475,495 | A * | 10/1984 | Lydell | 123/197.3 |
| 4,538,557 | A * | 9/1985 | Kleiner et al. | 123/78 E |
| 4,899,705 | A * | 2/1990 | Reed | 123/197.4 |
| 4,917,066 | A * | 4/1990 | Freudenstein et al. | 123/48 B |
| 5,136,987 | A * | 8/1992 | Schechter et al. | 123/48 B |
| 5,163,386 | A * | 11/1992 | Schechter | 123/48 B |
| 5,189,994 | A * | 3/1993 | Gindentuller | 123/54.2 |
| 7,159,543 | B2 * | 1/2007 | Hotta et al. | 123/48 R |
| 7,162,935 | B2 * | 1/2007 | Meyer | 74/586 |
| 7,174,863 | B2 * | 2/2007 | Scalzo | 123/48 B |
| 7,174,865 | B2 * | 2/2007 | Sakita | 123/78 F |
| 7,213,563 | B2 * | 5/2007 | Yaguchi et al. | 123/197.3 |
| 2002/0043228 | A1 * | 4/2002 | Moteki | 123/78 E |
| 2003/0051685 | A1 * | 3/2003 | Hiyoshi et al. | 123/78 E |
| 2005/0028762 | A1 * | 2/2005 | Shiraishi et al. | 123/78 E |
| 2007/0044739 | A1 * | 3/2007 | Clarke | 123/78 F |

FOREIGN PATENT DOCUMENTS

| | | |
|---|---|---|
| DE | 35 21 626 | 12/1986 |
| DE | 41 38 210 | 4/1992 |
| DE | 100 26 643 | 10/2001 |
| FR | 607 215 | 6/1926 |

* cited by examiner

*Primary Examiner*—Hai H Huynh
(74) *Attorney, Agent, or Firm*—Collard & Roe, P.C.

(57) ABSTRACT

A reciprocating-piston internal combustion engine has a crank drive and a transmission lever indirectly coupled with the piston and intersecting the cylinder axis. The lever is articulated onto the crank drive's connecting rod and onto an adjustable bearing guided in the cylinder block. For greater variation of the translation of movements between crank drive and piston, the pulling and pushing rod connected with the piston has a guide at its end facing the transmission lever. The guide is preferably a pivotally-mounted slide shoe that engages into a guide extending along the transmission lever. The transmission lever is pivotally connected with the crankshaft connecting rod and connected with a setting drive for variably setting the articulation of the pulling and pushing rod on the transmission lever. A guide lever pivotally connected with the pulling and pushing rod and pivotally articulated onto the cylinder block guides the pulling and pushing rod.

9 Claims, 7 Drawing Sheets

OT
OT
UT
V
ZB
2
2
6
6
7
51
5
5
4
9
9
10
10
11
11
12
12
13
13
14
14
15
15
16
16
17
3
3

1
10
14
9
15
13
17
16
11
12
3
6
7
4
5
V 2
6
9
ZB
10
14
13
17
4
11
12
3

S
2
6
α5
4
3
OT
UT
8
5
DR

2
ZA
6
60ZB
5
4
H6
8
H4
3
DR

RECIPROCATING-PISTON INTERNAL COMBUSTION ENGINE

CROSS REFERENCE TO RELATED APPLICATIONS

Applicants claim priority under 35 U.S.C. §119 of German Application No. 10 2006 003 737.5 filed Jan. 24, 2006.

BACKGROUND OF THE INVENTION

1. Field of the Invention

The present invention relates to reciprocating-piston internal combustion engines having a crank drive and a transmission lever that is indirectly coupled with the piston and intersects the cylinder axis. The lever is articulated onto a connecting rod of a crank drive, on the one hand, and onto a bearing that is guided in the cylinder block but is adjustable, on the other hand.

2. The Prior Art

An internal combustion engine of this type is previously known from a schematic representation according to FIG. 3 in FR 607 215. A crank drive with connecting rod is coupled, by way of its outer connecting rod eye, with one end of a transmission lever that intersects the cylinder axis, and the other end of which is mounted on an excenter of a setting shaft disposed to pivot in the cylinder block. A second connecting rod, connected with the piston guided in the cylinder, is articulated on, approximately in the center region of the transmission lever.

By means of rotating the setting shaft, which is mounted in the cylinder block, with the excenter, displacement of the transmission lever crosswise to the cylinder axis takes place. Depending on the position of the transmission that has been set, a change in the position of the movement path of the piston in the cylinder occurs, and thereby a change in the compression ratio occurs.

When the transmission lever is displaced, the effective lever arm ratios of the two connecting rods that are articulated on do not change much with reference to the point of rotation of the transmission lever on the excenter of the setting shaft. The size of the stroke also does not change much.

Furthermore, an internal combustion engine in which a connecting rod moved by a crankshaft is guided by an axle, by way of its outer connecting rod eye, which axle is disposed at the end of a guide lever mounted to adjustably pivot in the cylinder block, is previously known according to FIG. 2 in DE 35 21 626 C2. This axle, which is guided both by the connecting rod and by the guide lever, engages into a guide, which extends in the longitudinal axis, of a transmission lever that can pivot, which is mounted in a fixed position on one end. This transmission lever pivots about a plane that runs approximately crosswise to the cylinder axis, whereby a second connecting rod connected with a piston is articulated onto its other end.

By means of adjusting the bearing of the guide lever in the housing, the axle connected with it and moved by the connecting rod on the crankshaft is also displaced. As a result, the effective lever length of the axle that also engages into the guide of the transmission lever changes.

The effective lever length of the second connecting rod, connected with the piston, on the transmission lever is constant. As a consequence, both the size of the piston stroke and the compression with the previously described drive mechanism in the case of an internal combustion engine can be varied by means of changing the effective lever length of the engaging axle.

It is a disadvantage that the setting range is low, and that as compared with the first embodiment of the invention according to FIGS. 1-3 discussed below, a guide lever additionally moves, with an oscillating movement, in addition to the piston, the transmission lever, and two connecting rods.

SUMMARY OF THE INVENTION

It is an object of the invention to achieve a greater variation of the translation of movements between crank drive and piston, in the case of an internal combustion engine of the type stated.

These and other objects are achieved, according to the invention, by means of a reciprocating-piston internal combustion engine in which the piston is connected with a pulling and pushing rod, the pulling and pushing rod engages into a guide that extends along the transmission lever, a guide (ever is articulated onto the pulling and pushing rod so as to pivot and articulated onto the cylinder block on its side facing away from the pulling and pushing rod so as to pivot, and the transmission lever is disposed to be adjustably displaceable by means of a setting drive relative to its articulation with the pulling and pushing rod.

According to the invention, the pulling and pushing rod connected with a piston of the internal combustion engine has a guide, at its end facing the transmission lever. The guide is preferably configured as a slide shoe that is mounted to pivot. The shoe engages into a guide that extends along the transmission lever. In this connection, the transmission lever is connected with a connecting rod of the crankshaft so as to pivot, on the one hand, and on the other hand, the transmission lever is connected with a setting drive, for variably setting the articulation of the pulling and pushing rod on the transmission lever. Guidance of the pulling and pushing rod takes place by means of a guide lever that is connected with the pulling and pushing rod so as to pivot, on the one hand, and on the other hand is articulated onto the cylinder block so as to pivot.

The slide shoe can alternatively be configured as any desired guide that displaceably guides the connecting rod on the transmission lever, e.g. as an oblong hole in the transmission lever, into which a journal configured on the connecting rod engages.

With the embodiments according to the invention, a greater variation of the translation of movements between crank drive and piston can be implemented, as compared with the previously known solution of the type stated. In the first embodiment, only three transmission elements, aside from the piston, move with an oscillating movement. Specifically the transmission lever, a connecting rod, and the pulling and pushing rod connected with the piston and provided with the slide shoe oscillate.

In one variant, the required guidance of the pulling and pushing rod of the piston also takes place by means of a guide lever, but in order to reduce the forces that occur, this lever is mounted on the cylinder block in vertically displaceable manner.

In another variant, the pulling and pushing rod of the piston is guided via a slide guide disposed parallel to the cylinder axis, in place of the guide lever.

BRIEF DESCRIPTION OF THE DRAWINGS

Other objects and features of the present invention will become apparent from the following detailed description considered in connection with the accompanying drawings. It should be understood, however, that the drawings are designed for the purpose of illustration only and not as a definition of the limits of the invention.

In the drawings, wherein similar reference characters denote similar elements throughout the several views.

DETAILED DESCRIPTION OF PREFERRED EMBODIMENTS

Figure 1:
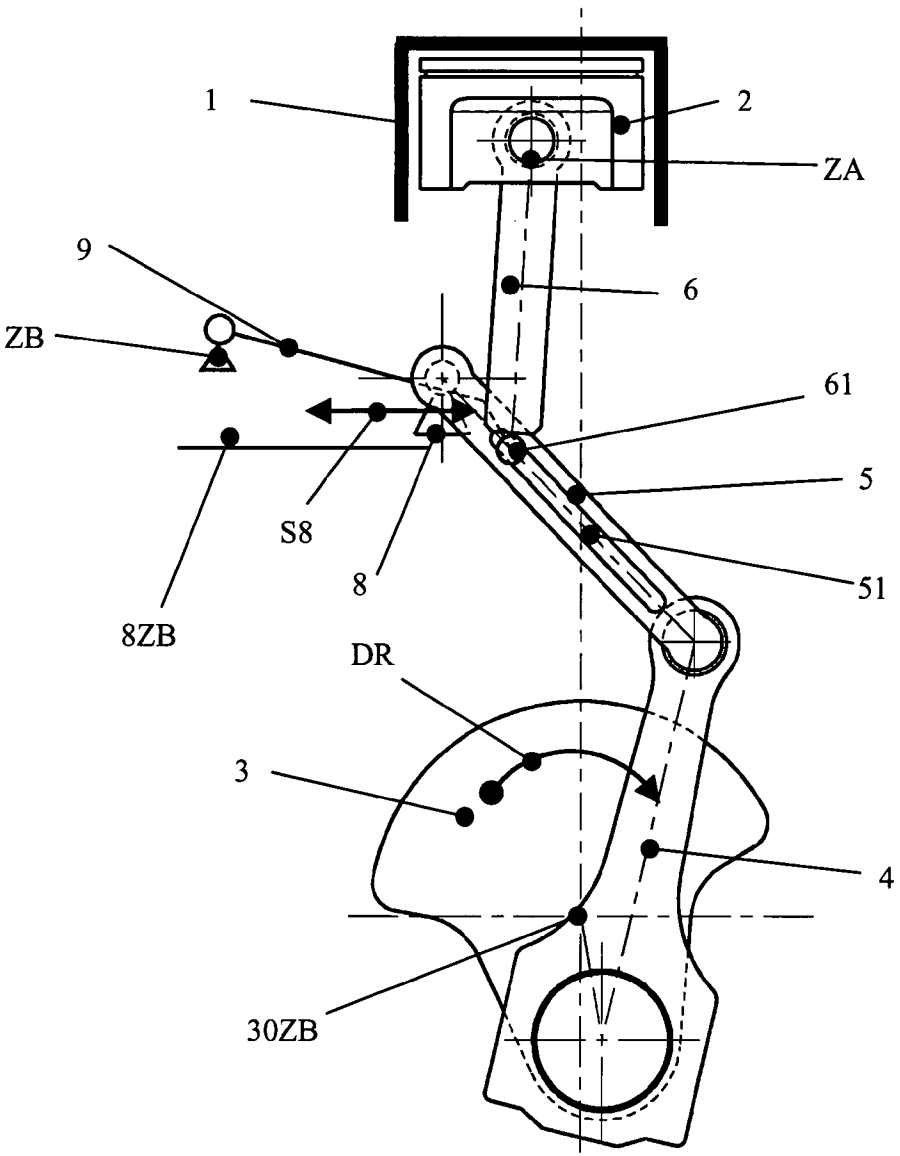
FIG. 1 shows schematically the drive mechanism of a reciprocating-piston internal combustion engine according to an embodiment of the invention in a setting for low stroke.

Referring now in detail to the drawings, FIG. 1 shows the drive mechanism of a reciprocating-piston internal combustion engine according to an embodiment of the invention in a schematic representation. A cylinder 1 is disposed in a cylinder block, not shown; a piston 2 moves in the cylinder block and forms a working space whose volume can change, in known manner, as a function of the size of the stroke.

A crankshaft 3 rotates in a bearing 30ZB in the cylinder block, which is offset relative to the cylinder axis ZA, in the direction of rotation DR.

A connecting rod 4 is mounted on crank of crankshaft 3, the outer bearing eye of which rod is articulated onto the end of a transmission lever 5.

Piston 2 is connected with a pulling and pushing rod 6, with shape fit; a journal 61 is disposed at the other end of the rod, which journal engages into an oblong hole or guide 51 of transmission lever 5.

Transmission lever 5 is mounted in a bearing 8 adjustably guided in the cylinder block, so as to pivot. A shape-fitted bearing guide 8ZB is disposed in the cylinder block, in which guide a bearing 8 can be adjusted, defined in its position, using a setting drive, not shown. The changes in position of bearing 8, which can be controlled by means of the setting drive, not shown, are symbolically represented in FIG. 1 by means of the arrow labeled S8.

Bearing guide 8ZB is always oriented crosswise to the cylinder axis ZA, but it can be disposed at a right angle or also running at an incline, in practical manner. However, bearing guides 8ZB that run at an incline to the cylinder axis ZA are not shown in the drawings.

A guide lever 9 is articulated onto the pulling and pushing rod 6, so as to pivot; it is articulated onto the cylinder block ZB on its side facing away from pulling and pushing rod 6. Thus, guidance of pulling and pushing rod 6 takes place by means of guide lever 9. In the case of a displacement of bearing 8 of transmission lever 5, the side of connecting rod 4 that faces transmission lever 5 is displaced relative to transmission lever 5, in its oblong hole 51, because of guide lever 9 that is mounted on cylinder block ZB in a fixed position, but so as to pivot. The position of transmission lever 5, which is displaceable along its bearing guide 8ZB, as shown in FIG. 1, results in a movement of piston 2 with low stroke.

Figure 8:
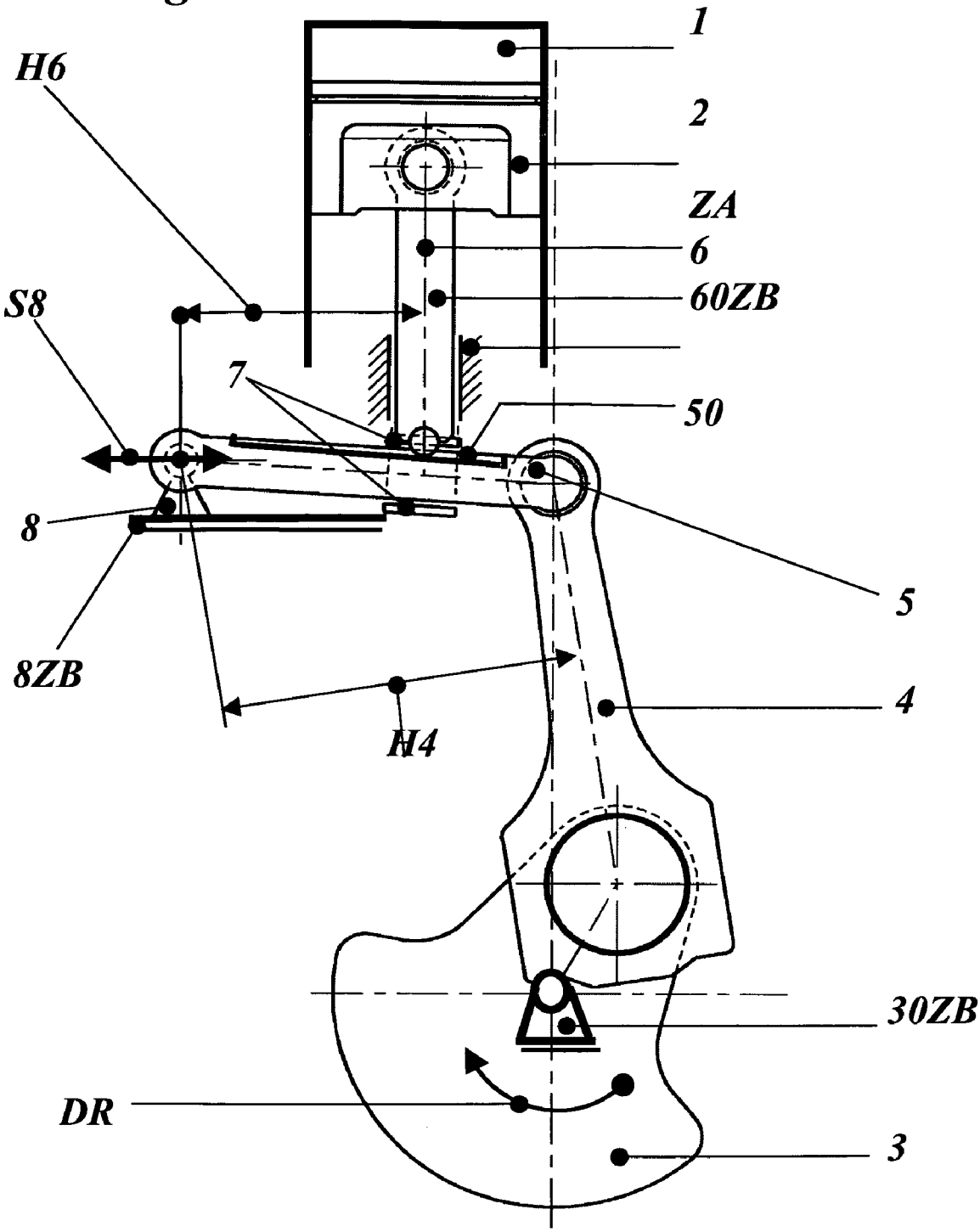
FIG. 8 shows schematically another variant of the drive mechanism of a reciprocating-piston internal combustion engine according to another embodiment of the invention, in a setting for high stroke.

The displaceable connection between pulling and pushing rod 6 and transmission lever 5 can also be brought about, as shown in FIG. 8, by means of a slide shoe 7 articulated onto the bottom end of pulling and pushing rod 6, so as to pivot, which shoe engages into a slide guide 50 that extends in the longitudinal axis of transmission lever 5, with shape fit.

Figure 2:
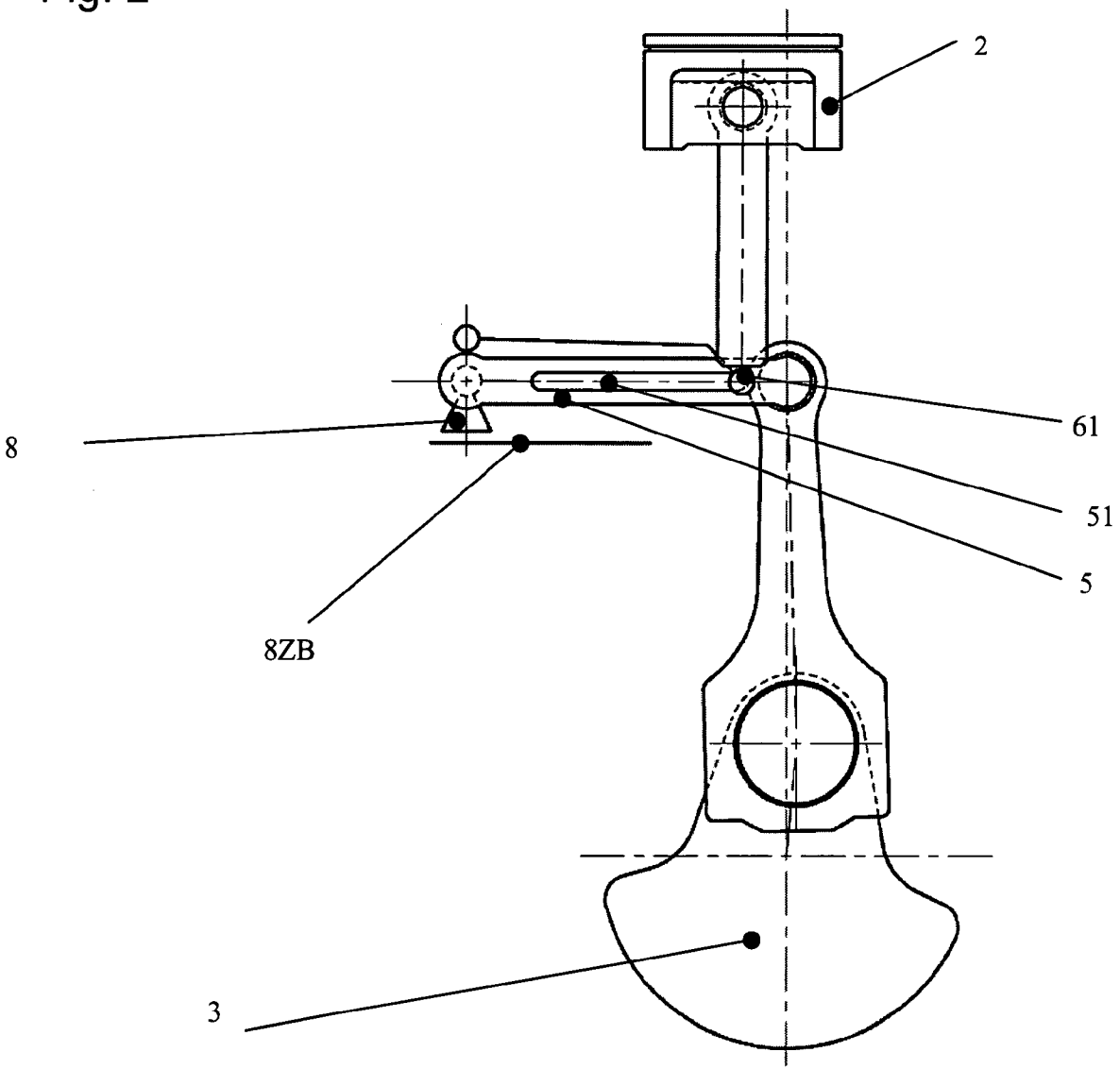
FIG. 2 shows the same drive mechanism corresponding to FIG. 1, but in a setting for high stroke.

In FIG. 2, the drive mechanism corresponding to FIG. 1 is shown but in a setting for high stroke of piston 2. Bearing 8 of transmission lever 5 is displaced to the left along its bearing guide 8ZB in the cylinder block. Therefore, a greater stroke movement of piston 2 takes place with one revolution of crankshaft 3, as compared with that shown in FIG. 1.

Figure 3:
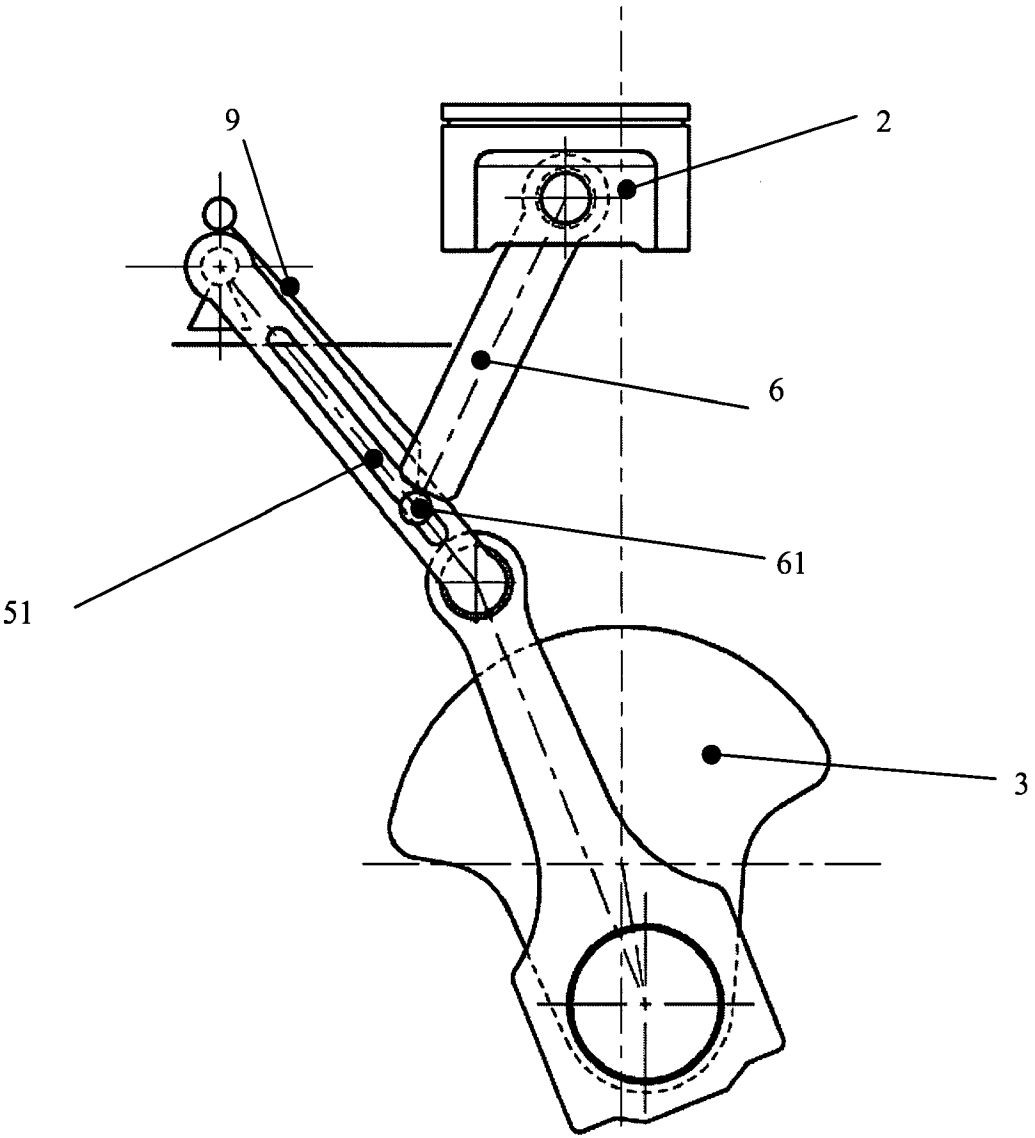
FIG. 3 shows the drive mechanism in a setting according to FIG. 2 for high stroke, but with a setting of the crankshaft at which the piston reaches the bottom dead center.

FIG. 3 shows the drive mechanism in a setting according to FIG. 2 for high stroke, but with a setting of crankshaft 3 at which piston 2 has reached the bottom dead center UT. In this connection, pulling and pushing rod 6 pivots out of its vertical position and is necessarily guided in oblong hole 51 of transmission lever 5 by guide lever 9.

FIGS. 4 to 7 show a further embodiment according to the invention, in which the friction between slide shoe 7 or journal 61 of pulling and pushing rod 6, respectively, and transmission lever 5 is further reduced. The adjustment of the stroke of piston 2 also takes place by means of displacement of transmission lever 5 by means of a setting drive, so that the articulation point of pulling and pushing rod 6 on transmission lever 5 is displaced in accordance with the stroke to be set. The guidance of pulling and pushing rod 6 also takes place by means of guide lever 9, but this lever is articulated onto a vertically displaceable slide guide 10 that is disposed on cylinder block ZB so as to pivot.

The setting drive for setting and changing the stroke essentially is made up of a worm shaft 12 that is connected to interact with a worm wheel 11. During the adjustment of worm shaft 12, worm wheel 11 is pivoted about its pivot point 16. Worm wheel 11 is pivoted either up or down by means of adjusting the direction of rotation of worm shaft 12.

Worm wheel 11 is connected with guide lever 9 and a slide guide 10, in articulated manner, at a distance from pivot point 16, by way of an advancing lever 14 that is articulated on so as to pivot, for one thing. For another thing, worm wheel 11 is connected with transmission lever 5, in articulated manner, by way of a rocker 15 that is articulated on so as to pivot. In this connection, the pivoting articulation of advancing lever 14 and of rocker 15 on worm wheel 11 takes place by way of a common pivot bolt. Articulation of advancing lever 14 and of guide lever 9 on vertically displaceable slide guide 10 that is disposed on cylinder block ZB also takes place by way of a common pivot bolt.

In the center region of rocker 15, a two-beat lever 13 is articulated on so as to pivot; its other end is mounted fixed in place on cylinder block ZB, but so as to pivot. With this arrangement, the result is achieved that when worm wheel 11 is pivoted, rocker 15 is pivoted about the articulation point of two-beat lever 13 on cylinder block ZB. Because of the pivoting movement of rocker 15 about a pivot point 17, transmission lever 5 is displaced, whereby the articulation point of pulling and pushing rod 6 on transmission lever 5 is displaced in accordance with the stroke to be set. At the same time, guide lever 9 that is articulated onto slide guide 10 is adjusted by means of the pivoting of worm wheel 11, which lever also influences the adjustment of the articulation of pulling and pushing rod 6 on transmission lever 5. Because of this measure, the result is achieved that particularly when adjusting the stroke, the friction of slide shoe 7 of pulling and pushing rod 6 on transmission lever 5 is reduced during displacement of transmission lever 5 relative to slide shoe 7 or journal 61, respectively.

By means of coupling the two thrust crank mechanisms by way of the common articulation point of rocker 15 and of advancing lever 14 on worm wheel 11, and the guidance of advancing lever 14 and of guide lever 9 on slide guide 10, the result is achieved that in addition to the stroke adjustment to a low stroke, a compression follow-up V takes place, by means of shifting the top dead center OT in the direction of the cylinder head. It is also possible that the displacement of slide guide 10 takes place by means of a separate drive, with the aim of separate compression variability, instead of by means of advancing lever 14.

Figures 4, 5:
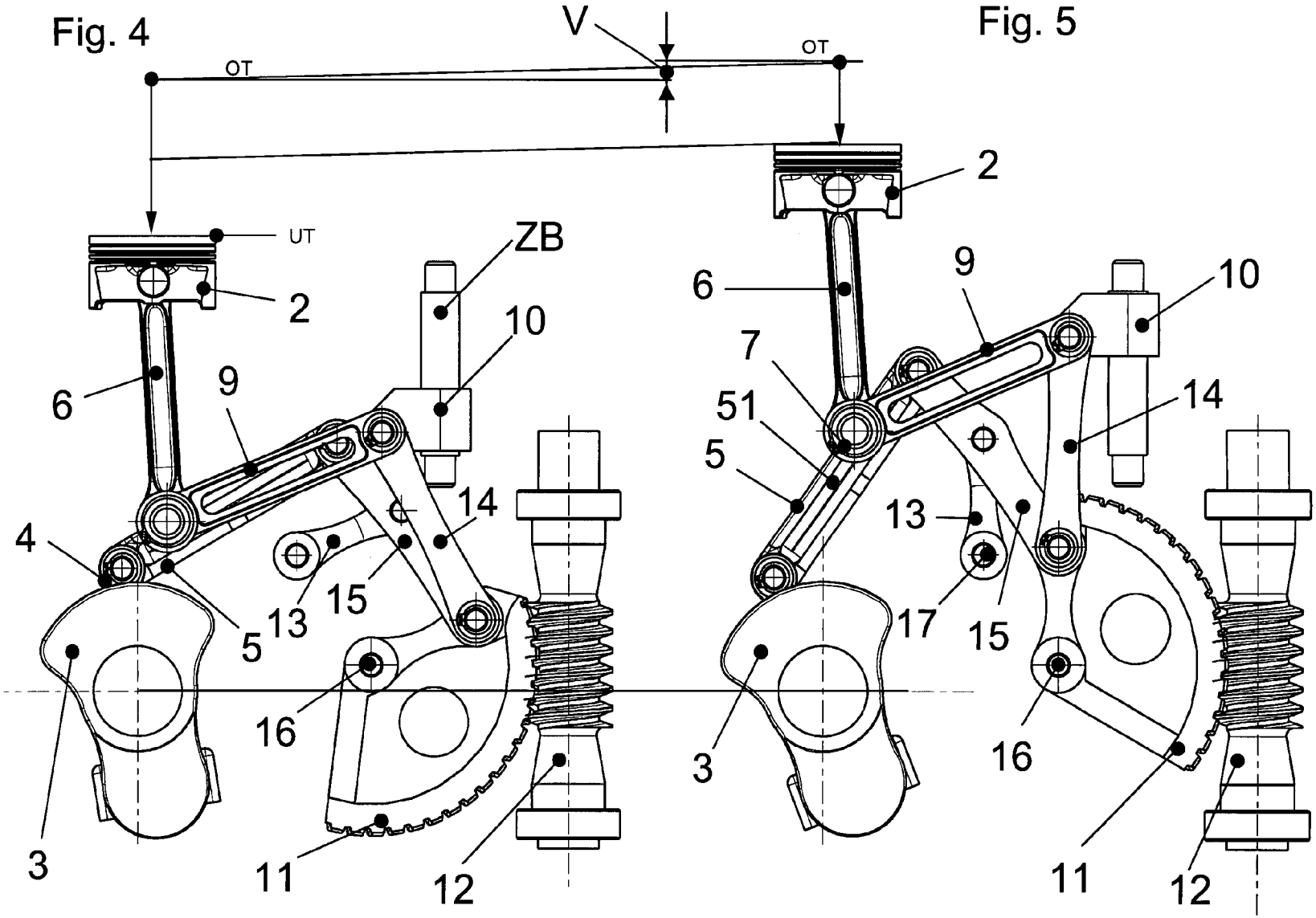
FIG. 4 shows schematically a variant of the drive mechanism of a reciprocating-piston internal combustion engine according to another embodiment of the invention, in a setting for high stroke and a setting of the crankshaft at which the piston reaches the bottom dead center.
FIG. 5 shows the drive mechanism according to FIG. 4, but in a setting for low stroke.
Figures 6, 7:
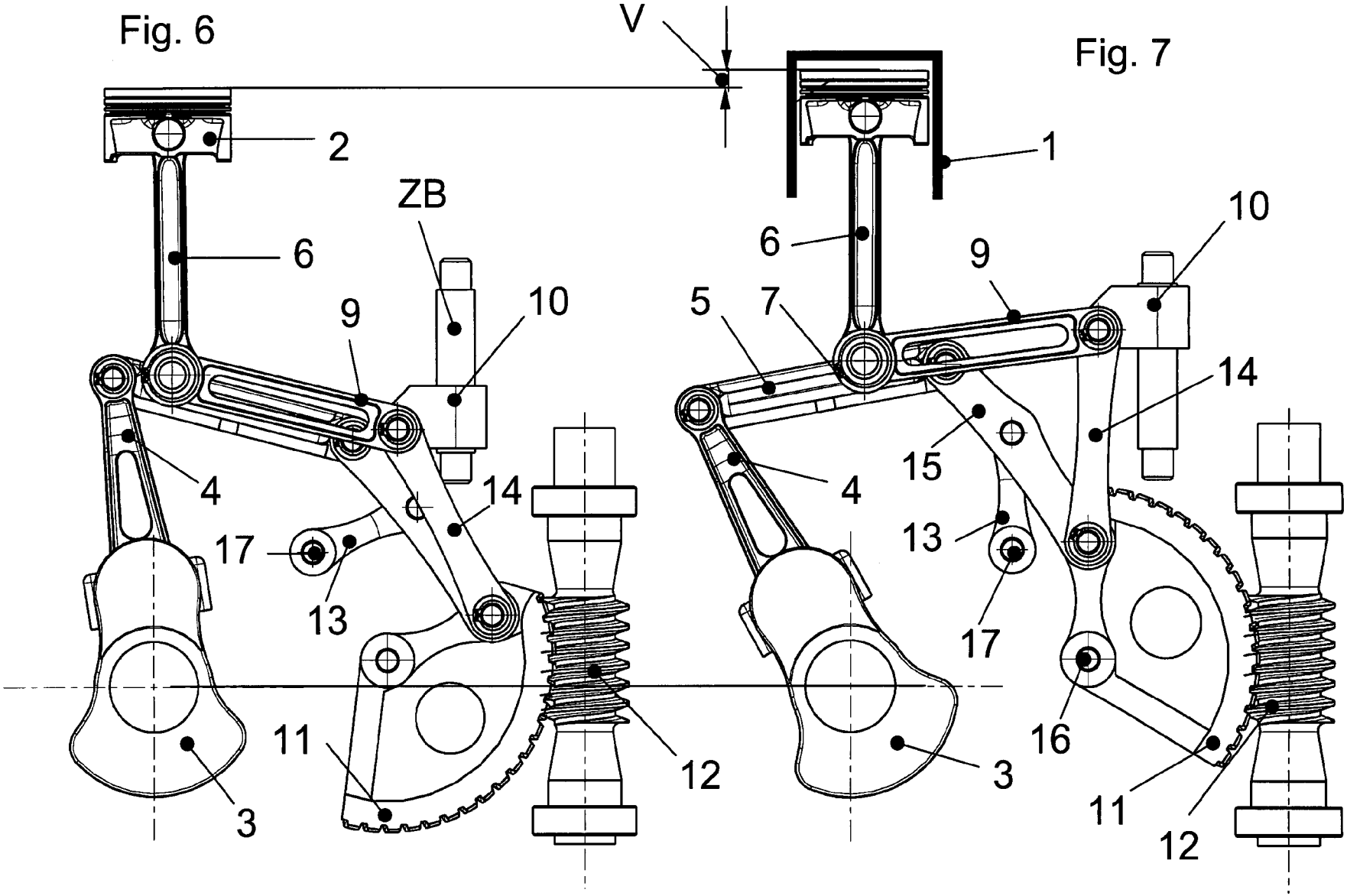
FIG. 6 shows the drive mechanism according to FIG. 5, but with a setting of the crankshaft at which the piston reaches the top dead center.
FIG. 7 shows the drive mechanism according to FIG. 6, but in a setting for low stroke.

In FIGS. 4 and 6, a high stroke setting is shown, in each instance, whereby FIG. 4 shows the position of piston 2 at the bottom dead center UT, and FIG. 6 shows the position of piston 2 at the top dead center OT. From the drawings, it is evident that slide guide 10 is in its bottom position, and the articulation point of rocker 15 and of advancing lever 14 on worm wheel 11 lies close to worm shaft 12.

In the case of a low stroke setting, as shown in FIGS. 5 and 7, the articulation point of rocker 15 and of advancing lever 14 on worm wheel 11 is moved up, as compared to the positions shown in FIGS. 4 and 6, and pivoted away from worm shaft 12, by means of rotating worm shaft 12. At the same time, slide guide 10 is displaced vertically upward. FIG. 5 shows piston 2 at the bottom dead center UT, while FIG. 7 shows the position of piston 2 at the top dead center OT.

Figures 9, 10:
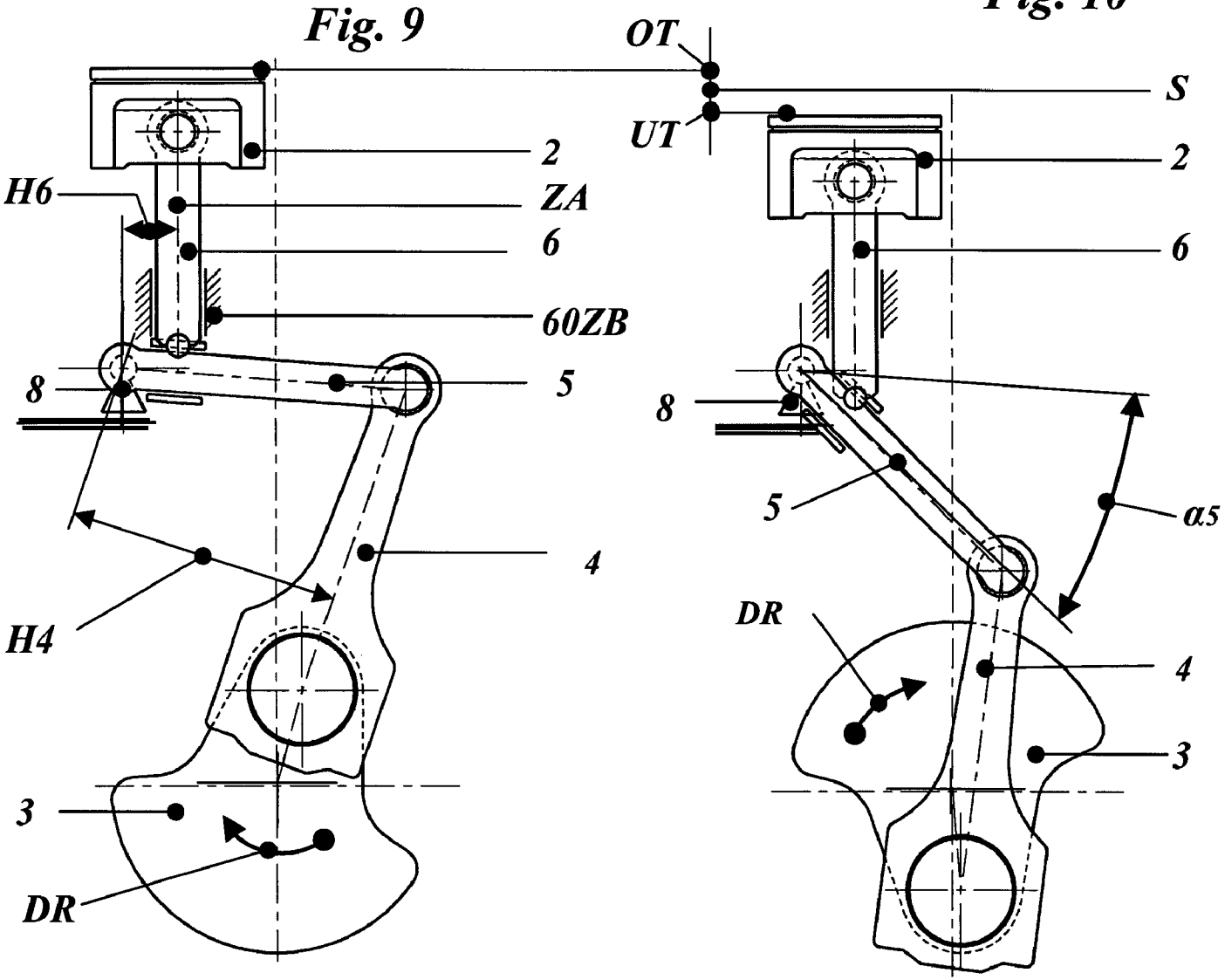
FIG. 9 shows the same drive mechanism corresponding to FIG. 8, but in a setting for low stroke and a setting of the crankshaft at which the piston reaches the top dead center.
FIG. 10 shows the drive mechanism in a setting according to FIG. 9 for low stroke, but with a setting of the crankshaft at which the piston reaches the bottom dead center.

Another embodiment according to the invention is shown in FIGS. 8 to 10. In this connection, the guidance of pulling and pushing rod 6 takes place not by means of guide lever 9, but rather by means of a slide guide 60ZB disposed in cylinder block ZB. Transmission lever 5 is also displaceable in a bearing 8, which can be displaced by means of a setting drive, not shown, in order to set the stroke, and is mounted so as to pivot. FIG. 8 shows a position of the drive mechanism after it has passed through the top dead center OT, in the case of a setting for high stroke. The length ratio between the effective lever arm H4 of connecting rod 4 on transmission lever 5 and the effective lever arm H6 of pulling and pushing rod 6 connected with piston 2 is approximately 7 to 10.

In FIGS. 9 and 10, the drive mechanism is shown at a setting for low stroke, in each instance.

FIG. 9 shows the drive mechanism elements at a piston setting in the top dead center OT, and FIG. 10 at a piston setting in the bottom dead center UT. With every stroke, transmission lever 5 moved by connecting rod 4 pivots by an angle $\alpha$5, whereby piston 2 moves along the path S between OT and UT during this time.

In FIG. 9, the drive mechanism elements are shown at a piston setting in the top dead center OT. The length ratio between effective lever arm H4 of connecting rod 4 on transmission lever 5 and effective lever arm H6 of pulling and pushing rod 6 connected with piston 2 is approximately 2 to 10.

In a comparison of FIGS. 8 and 9, the effect of the different positions of bearing 8 and the change in the length ratio of effective lever arms H4 and H6 relative to one another is clearly evident. The change in the length ratios of effective lever arms H4 and H6 also applies, of course, for the drive mechanism elements shown in FIGS. 1 to 7.

The solution according to the invention can be used not only in reciprocating-pistol engines, but also in other reciprocating-piston machines, such as axial compressors or expanders, for example.

Although only a few embodiments of the present invention have been shown and described, it is to be understood that many changes and modifications may be made thereunto without departing from the spirit and scope of the invention as defined in the appended claims.

What is claimed is:

1. A reciprocating-piston internal combustion engine comprising:

(a) a cylinder block;

(b) a cylinder having a cylinder axis disposed in said cylinder block;

(c) an adjustable bearing guided in said cylinder block;

(d) a piston movable in said cylinder;

(e) a crank drive having a connecting rod;

(f) a transmission lever indirectly coupled with said piston and intersecting the cylinder axis, said transmission lever being articulated onto said connecting rod at an articulation location and onto said adjustable bearing and having a guide extending along the transmission lever;

(g) a pulling and pushing rod connected with said piston and engaging into said guide;

(h) a guide lever pivotally articulated onto said pulling and pushing rod and pivotally articulated onto said cylinder block on a side of said guide lever facing away from said pulling and pushing rod; and (i) a setting drive for adjustably displacing said transmission lever relative to the articulation location of said transmission lever with said pulling and pushing rod.

2. The reciprocating-piston internal combustion engine according to claim 1, wherein the pulling and pushing rod is connected with the transmission lever by way of a slide shoe mounted on the pulling and pushing rod so as to pivot, the slide shoe engaging into said guide that extends along the transmission lever.

3. The reciprocating-piston internal combustion engine according to claim 1, wherein the pulling and pushing rod engages into an oblong hole of the transmission lever with a journal.

4. The reciprocating-piston internal combustion engine according to claim 1, wherein the guide lever is pivotally mounted on the cylinder block.

5. The reciprocating-piston internal combustion engine according to claim 1, wherein the transmission lever comprises a displaceable bearing disposed in the cylinder block and guided crosswise to the cylinder axis.

6. The reciprocating-piston internal combustion engine according to claim 1, further comprising a bearing guide running at an incline and oriented crosswise to the cylinder axis.

7. The reciprocating-piston internal combustion engine according to claim 1, wherein the guide lever is articulated onto a displaceable slide guide that is vertically displaceable on the cylinder block so as to pivot.

8. The reciprocating-piston internal combustion engine according to claim 7, wherein the setting drive for displacing the articulation location of the pulling and pushing rod on the transmission lever comprises a worm wheel that can be pivoted by way of a driven worm shaft about a pivot point, an advancing lever and a rocker, said advancing lever having a first lever end pivotally disposed on said worm wheel at a distance from said pivot point and a second lever end pivotally connected with the displaceable slide guide and the guide lever, said rocker having a first rocker end pivotally disposed on said worm wheel at a distance from said pivot point and a second rocker end pivotally connected with an end of the transmission lever.

9. The reciprocating-piston internal combustion engine according to claim 7, wherein the rocker is pivotally disposed by way of a two-beat lever that is pivotally mounted on the cylinder block so as to pivot about a lever pivot point of said two-beat lever.

* * * * *